US006018157A

United States Patent [19]

Craft

[11] Patent Number: 6,018,157

[45] Date of Patent: Jan. 25, 2000

[54] MICROWAVE COOKING GRILL WITH SEALED ENCLOSURE OF INERT GAS

[75] Inventor: Paul I. Craft, Fairbanks, Ak.

[73] Assignee: W.C. Linden, Inc., Dallas, Tex.

[21] Appl. No.: 09/123,116

[22] Filed: Jul. 27, 1998

[51] Int. Cl.[7] ..... H05B 6/80

[52] U.S. Cl. ..... 219/730; 219/732; 219/762; 219/686; 219/735; 99/DIG. 14; 426/107; 426/243

[58] Field of Search ..... 219/730, 759, 219/732, 725, 762, 763, 686, 735; 99/DIG. 14; 426/107, 243, 234, 241

[56] References Cited

U.S. PATENT DOCUMENTS

| | | | |
|---|---|---|---|
| 3,591,751 | 7/1971 | Goltsos | 219/730 |
| 3,946,187 | 3/1976 | MacMaster | 219/730 |
| 4,272,663 | 6/1981 | Green | 219/10.55 E |
| 4,362,917 | 12/1982 | Freedman et al. | 219/732 |
| 4,439,656 | 3/1984 | Peleg | 219/10.55 E |
| 4,529,855 | 7/1985 | Fleck | 219/730 |
| 4,641,005 | 2/1987 | Seiferth | 219/105.5 E |
| 4,748,308 | 5/1988 | Drews | 219/732 |
| 4,931,608 | 6/1990 | Bills | 219/759 |
| 4,937,412 | 6/1990 | Dorby | 219/10.55 |
| 4,983,798 | 1/1991 | Eckler et al. | 219/759 |
| 5,094,865 | 3/1992 | Levinson | 426/243 |
| 5,317,118 | 5/1994 | Brandberg et al. | 219/730 |
| 5,770,840 | 6/1998 | Lorence | 219/730 |

*Primary Examiner*—Philip H. Leung
*Attorney, Agent, or Firm*—Gregory M. Howison; Mark W. Handley

[57] ABSTRACT

An apparatus is disclosed for use in microwave ovens to heat the exterior peripheries of food items to temperatures such that moisture is evaporated from the outer regions of the food items which are adjacent to the exterior peripheries. The apparatus includes an enclosure which is permeable to microwave energy and which defines a sealed interior cavity in which an inert gas is disposed. The inert gas is of the type that will be energized to generate radiant heat when exposed to the microwave energy of a conventional microwave oven. The enclosure defines an exterior heating surface which is placed adjacent to and transfers the heat from the inert gas directly to the peripheries of the food items. The apparatus preferably further includes a second enclosure having a second heating surface for disposing adjacent to a second side of the periphery of the food item, opposite that of the first enclosure and first heating surface. A drip pan is provided for catching drippings from the food item being grilled. The second enclosure is adjustably supported relative to the first enclosure such that the distance between the heating surfaces of the upper and lower enclosures may be varied to accommodate food of various sizes. A vented cover is provided for sealing against the drip pan, and includes adjustable vents.

24 Claims, 3 Drawing Sheets

MICROWAVE COOKING GRILL WITH SEALED ENCLOSURE OF INERT GAS

TECHNICAL HELD OF THE INVENTION

The present invention pertains in general to ovens for cooking foods, and more particularly to a grill utensil for use in a microwave oven.

BACKGROUND OF THE INVENTION

Microwave ovens are commonly used in households for warming, and sometimes for cooking food. However, microwave ovens do not heat foods in the same manner as traditional ovens. Traditional ovens have a heat source which is located exterior of a food item being cooked. Heat is transferred from the heat source of the conventional oven to the surface of the food, and then passed by conduction from the exterior to the interior of the food item. This type of heat transfer mechanism requires that the outer regions of the food be heated to higher temperatures than interior regions, such that a thermal gradient will exist to cause heat transfer from the exterior surface to the interior regions of the food. Since traditional cooking ovens, at least initially, heat the exterior of food items to higher temperatures than the interior, the exterior regions of the food items are cooked first, and are often seared to contain moisture within the interior regions of the food items being cooked. After a sustained period of time within a traditional oven, the temperatures of the interior regions of the food items may approach the exterior temperatures.

When food is cooked in microwave ovens, typically the interior of the food is heated to higher temperatures than the exterior of the food. Microwave energy permeates a food item, such that interior regions of the food item will be cook faster than the exterior perimeter. The exterior perimeter of the food item being cooked is typically exposed to ambient air within the microwave oven, which is typically at ambient or room temperatures. The ambient temperature air within the cooking compartment of the microwave oven will absorb heat from the exterior perimeter of the food, cooling the exterior perimeter to temperatures which are lower than those in the interior regions of the food item. The higher temperatures of the interior regions cause moisture to outgas from the interior regions and move toward the cooler exterior perimeter of the food, resulting in moisture saturation of the region of the food item adjacent to the exterior perimeter of the food. The typical result is that the exterior surfaces of food items cooked in microwave ovens become spongy or mushy due to the moisture saturation at the exterior peripheral surfaces of the food.

For some food items, such as meats, poultry, fish, breads and the like, it is desirable to heat the exterior regions of the food to higher temperatures than the interior regions so that the exterior regions will become dry while the interior regions remain moist. Although microwave ovens can heat food faster than traditional cooking ovens, microwave ovens have not replaced traditional ovens since it is often preferable to heat food items such that the exterior regions of the food items are dryer than the interior regions of the food items.

SUMMARY OF THE INVENTION

The present invention as disclosed and claimed herein is directed towards a microwave grill for use in a microwave oven to heat exterior peripheries of food items to temperatures such that moisture is evaporated from the outer regions of the food items which are adjacent to the exterior peripheries. The microwave grill includes an enclosure which is permeable to microwave energy and which defines a sealed interior cavity. An inert gas is disposed within the sealed interior cavity. The inert gas is of a type that will be energized in response to exposure to microwave energy which is emitted within a conventional microwave oven and thus generate radiant heat. The enclosure has a heating surface which is placed adjacent to the periphery of a food item being cooked and transfers heat from the inert gas directly to the periphery of the food item. The apparatus preferably further includes a second enclosure having a second heating surface for being disposed adjacent to a second side of the periphery of the food item, opposite that of the first enclosure and first heating surface. A drip pan is provided for catching drippings from the food item being grilled. The second enclosure is adjustably supported relative to the first enclosure such that the distance between the heating surfaces of the upper and lower enclosures may be varied to accommodate food of various sizes. A vented cover is provided for sealing against the drip pan, and includes adjustable vents such that the vents may be selectably adjusted to provide a selected pressure within the grill and about the heating surfaces adjacent to the food item.

BRIEF DESCRIPTION OF THE DRAWINGS

For a more complete understanding of the present invention and the advantages thereof, reference is now made to the following description taken in conjunction with the accompanying Drawings in which like components are referred to with like reference numerals, and in which.

DETAILED DESCRIPTION OF THE INVENTION

Figure 1:
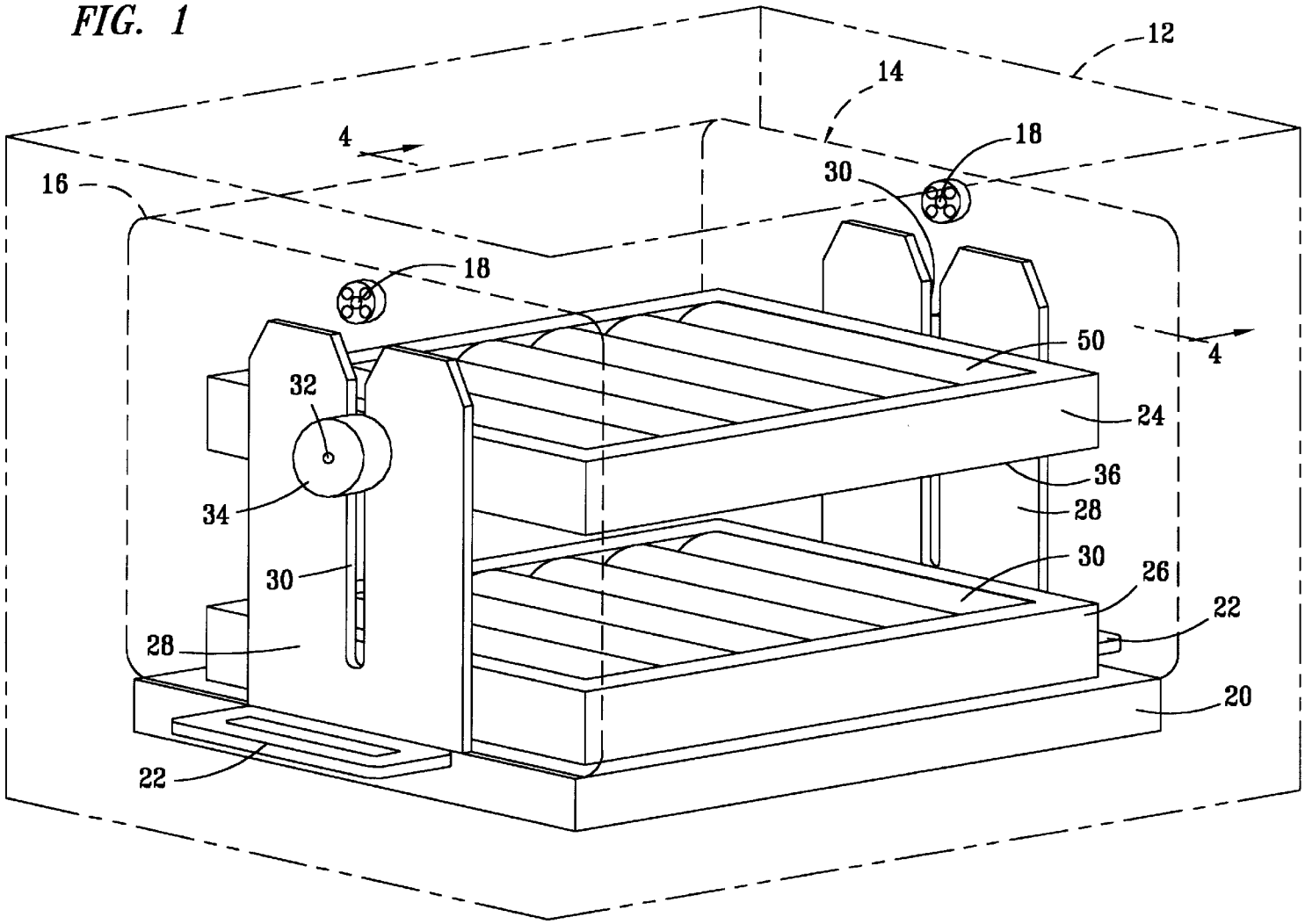
FIG. 1 illustrates a perspective view of a microwave grill made according to the present invention disposed therein.

Referring now to FIG. 1, there is illustrated a perspective view of a microwave oven 12 (shown in phantom) and a microwave grill 14 of the present invention for heating materials, such as food items. The microwave grill 14 includes a cover 16 made of polycarbonate. The cover 16 has two vents 18 for selectively adjusting to select positive cooking pressures within the cover 16. The microwave grill 14 further includes a drip pan 20. Two handles 22 are provided on the drip pan 20. The drip pan 20 and the handles 22 are also made of polycarbonate.

The microwave grill 14 further includes an upper heating unit 24 and a lower heating unit 26. The lower heating unit 26 mounts directly to the drip pan 20, such that the lower surface of the lower heating unit 26 fits substantially adjacent to the top of the drip pan 20. Two support members 28 are mounted to opposite longitudinal ends of the drip pan 20, and upwardly extend in vertical directions from the opposite ends of the drip pan 20. Two vertical slots 30 extend in central regions of the support members 28. Two rods 32 (shown in FIG. 2) are rigidly mounted to the side of the upper heating unit 24, with each of the rods 32 (shown in FIG. 2) extending from an opposite longitudinal end of the upper heating unit 24 than the other of the rods 32. The rods 32 horizontally extend in outward lateral directions from the sides of the opposite ends of the heating unit 24, configured such that each of the rods 32 is slidably received within a respective one of the two slots 30. The outward ends of the rods 32 are threaded. Two knobs 34 (one shown) threadingly engage the threaded outer ends of the rods 32, respectively, to provide clamping members for clamping the upper heating unit 24 to the support members 28 in selectable positions relative to lower heating unit 26. The support members 28, the rods 32 and the two knobs 34 are preferably made of polycarbonate.

The upper heating unit 24 provides an upper heating surface 36, and the lower heating unit 26 provides a lower heating surface 38. Preferably, the upper heating surface 36 is spaced above the lower heating unit 26 such that a food item may be placed upon the lower heating surface 38. Then, the adjustable knobs 34 are loosened such that the rods 32 may slide within the slots 30 of the support members 28. The lower heating unit 24 is moved downward toward the lower heating unit 26 until the upper heating surface 36 is in contact with, and preferably flush with, an upper periphery of the food item. The adjustment knobs 34 are rotated to clamp respective ones of the support members 28 between the knobs 34 and the exterior surfaces of upper heating unit 24.

Figure 2:
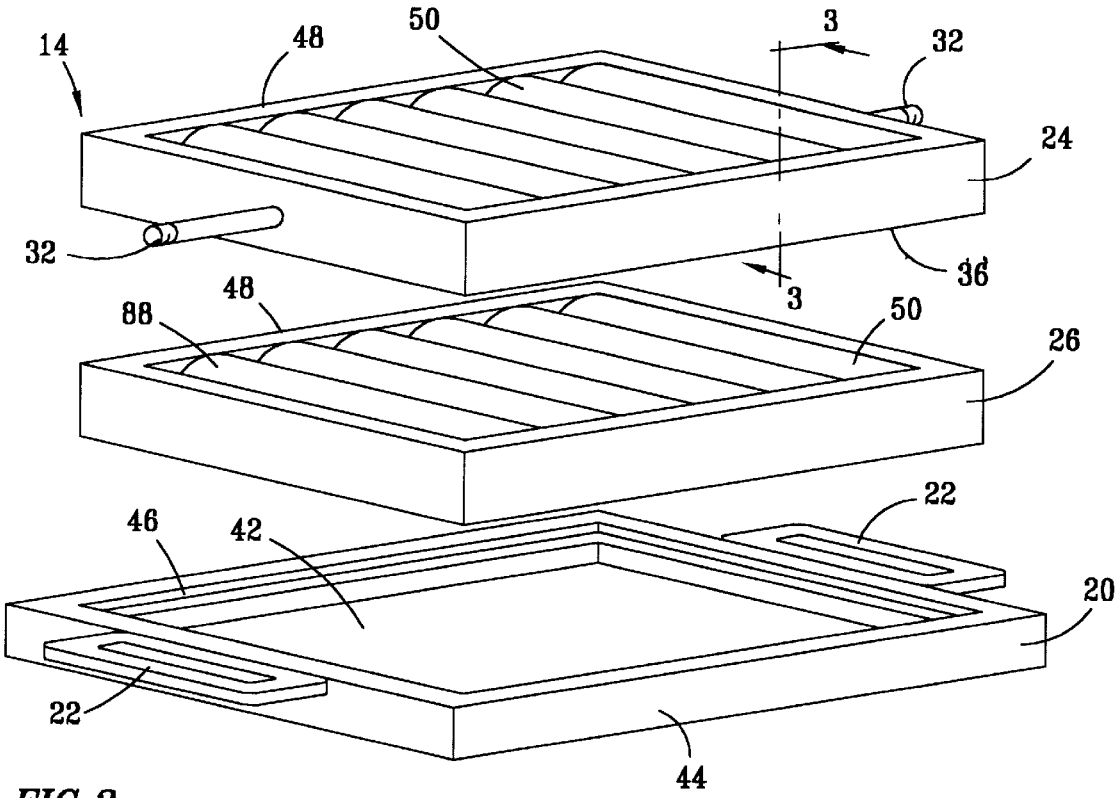
FIG. 2 illustrates a partial, exploded, perspective view of two heating units and a drip pan for the microwave grill.

Referring now to FIG. 2, there is illustrated a perspective view of a portion of the microwave grill 14. The upper heating unit 24 is spaced apart vertically above the lower heating unit 26. The lower heating unit 26 is depicted as being spaced apart above the drip pan 20. The drip pan 20 has a lower surface 42 and four sidewalls 44. Four protuberances 46 are provided to extend inwardly of the interior perimeter of the sidewalls 44 to provide a shoulder for resting the lower surface of the lower heating unit 26 upon. The protuberances 46 space the lower surface of the lower heating unit 26 apart from the lower surface 42 of the drip pan 20, such that the lower end of the lower heating unit 26 is not substantially lower than flush with the upwardly facing surfaces of the sidewalls 44 (as shown in FIG. 1) so that the lower heating unit 26 may be more fully exposed to microwave energy within the microwave oven 12 than if the sidewalls 44 were adjacent to the lower heating unit 26. The heating unit 26 is also spaced above the bottom 42 of the drip pan 20 to provide space for a reservoir for food drippings to collect within the drip pan 20. The upper heating unit 24 and the lower heating unit 26 are identical, except for the mounting rods 32 of the upper heating unit 24 for engaging within the slots 30 of the two supports 28. Each of the upper and lower heating units 24 and 26 include a frame 48 and a plurality of tubular glass enclosures 50. The frames 48 are made of polycarbonate and the enclosures 50 are preferable made of lead free quartz glass.

Figure 3:
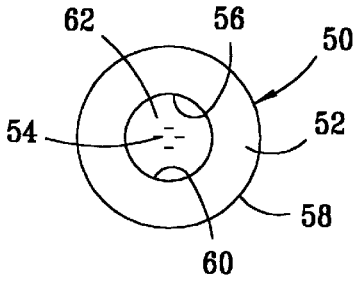
FIG. 3 illustrates a cross-sectional view of one of the tubular enclosures of one of the heating units of the microwave grill, taken along section line 3—3 of FIG. 2.

Referring now to FIG. 3, there is illustrated a sectional view of one of the glass tubes 50 of the upper heating unit 24, taken along section line 3—3 of FIG. 2. The glass tube 50 has a thick outer wall of 52 of uniform thickness, preferably one-sixteenth inches thick. Each of the tubes 50 provides a tubular enclosure for retaining an inert gas 54 in an interior cavity 56 of respective ones of the enclosures 50. The sidewalls 52 of the glass enclosures 50 each have an exterior surface 58 and an interior surface 60. Lowermost ends of the exterior surfaces 58 of the glass enclosures 50 of the upper heating unit 24 define the upper heating surface 36. Uppermost ends of the exterior surfaces 58 of the glass enclosures 50 of the lower heating unit 26 define the upper heating surface 38. Each end of the glass tubular enclosures 50 is sealed with a glass plug 62 (one shown) which are mounted to the frame 48.

As used herein, the term "inert gas" refers to a gas which will not detrimentally change in composition in response to the microwave energy and the temperatures to which it is raised when used according to the present invention, such that the gas may be used for repeated cooking cycles without requiring replacement and without significant degradation of the microwave grill 14. Preferably, neon is used for the inert gas. However, microwave grills of other embodiments may use other types of materials or gases, in gaseous, bulk or film form, which may be used for repeated cooking cycles according to the present invention.

Figure 4:
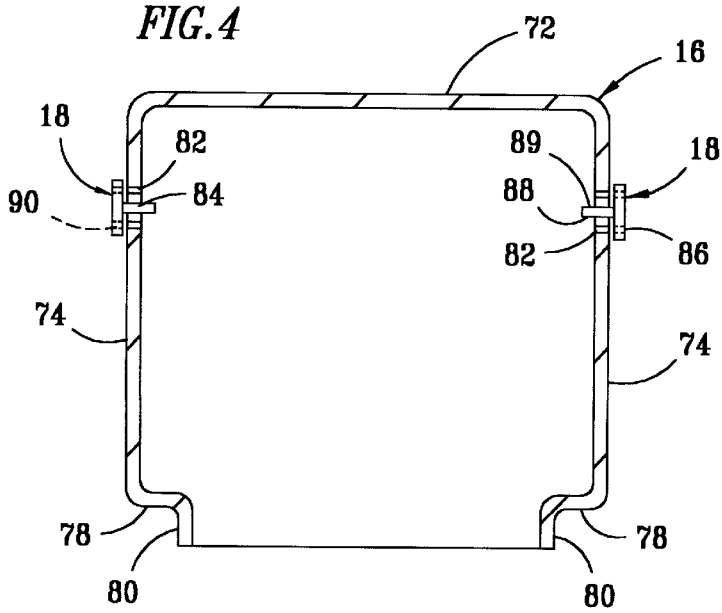
FIG. 4 illustrates a sectional view of the cover of the microwave grill, taken along section line 4—4 of FIG. 1.

Referring now to FIG. 4, there is illustrated a sectional view of the cover 16 taken along section line 4—4 of FIG. 1. The cover 16 has top 72 and sidewalls 74 which are made of polycarbonate. The vents 18 are disposed on two of the opposite facing walls 74. The top 72 and the sidewalls 74 are sealed, except for the two vents 18. The junctions between the edges of the top 72 and the upper portions of the walls 74 are curved. The lowermost ends of each of the four walls 74 extend inward at a right angle to an outermost side section to define shoulders 78. The laterally innermost edges of the shoulders 78 extend downward at a 90 degree angle to define lips 80. The lips 80 extend downwardly from the innermost edges the walls 74 of the cover 16 for fitting within the sidewalls 44 of the drip pan 20 (shown in FIGS. 1 and 2), such that the outward facing surfaces of the lips 80 fit flush against the inward facing surfaces of the sidewalls 44 so that the lips 80 will both slidingly engage within the sidewalls 44 for removal and insertion of the cover 16 relative to the drip pan 20, and will provide a seal for sealing positive pressure within the interior of the cover 16 during cooking. Preferably, this seal is not air-tight or fluid tight, but rather a restriction to air and vapor flow across the interface of the lips 80 of the cover 16 and the sidewalls 44 of the drip pan 20 which allows a slight positive pressure buildup within the cover 16 caused by moisture evaporation from a food item during cooking. The amount of pressure is determined by the selected settings of the vents 18.

The vents 18 in the cover 16 include two sets of ports 82 which extend through the sidewalls 74 of the cover 16. The each of the two sets of ports 82 are spaced apart in a circumferential pattern about a vent shudder mounting hole 84, each on respective opposite ends of the cover 16. The ports 82 and the mounting holes 84 preferably extend through the sidewalls 74. Two shutter members 86 are made of polycarbonate. The shutter members 86 each have a post 88 which extends into a respective one of the mounting holes 84. The posts 88 are rotatably mounted within the two mounting holes 84, respectively, and are retained within the holes 84 by a fastening members 89. In other embodiments, the posts 99 may be molded of a plastic material, with laterally extending tips which snap in the interior sides of the sidewalls 74 to latch the posts 88 within the mounting holes 84 of the cover 16. The shutter member 86 has a plurality of vent holes 90.

Figure 5:
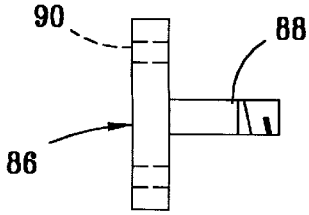
FIG. 5 illustrates a side view of one of the shutter members of one of the vents for the cover of the microwave grill.

Referring now to FIG. 5, there is illustrated a side view of one of the shutter members 86. The shutter member 86 includes a flat plate section from which the post 88 extends, with a longitudinal axis which is perpendicular to a plane of the surfaces of the flat plate section. The inward surface 92 of the shutter member 86 is a planar surface which mates with the corresponding planar section of the sidewalls 74 such that a low pressure seal will be provided between the shutter member 86 and the sidewalls 74 of the cover 16 during cooking. The vent holes 90 and the shutter member 86 are selectively aligned with the ports 82 in the walls 74, with the plainer surface of the shutter member 86 providing a low pressure seal with the exterior surface of the walls 74 of the cover 16. This allows a slight positive pressure to occur within the interior of the cover 16 during cooking.

Figure 6:
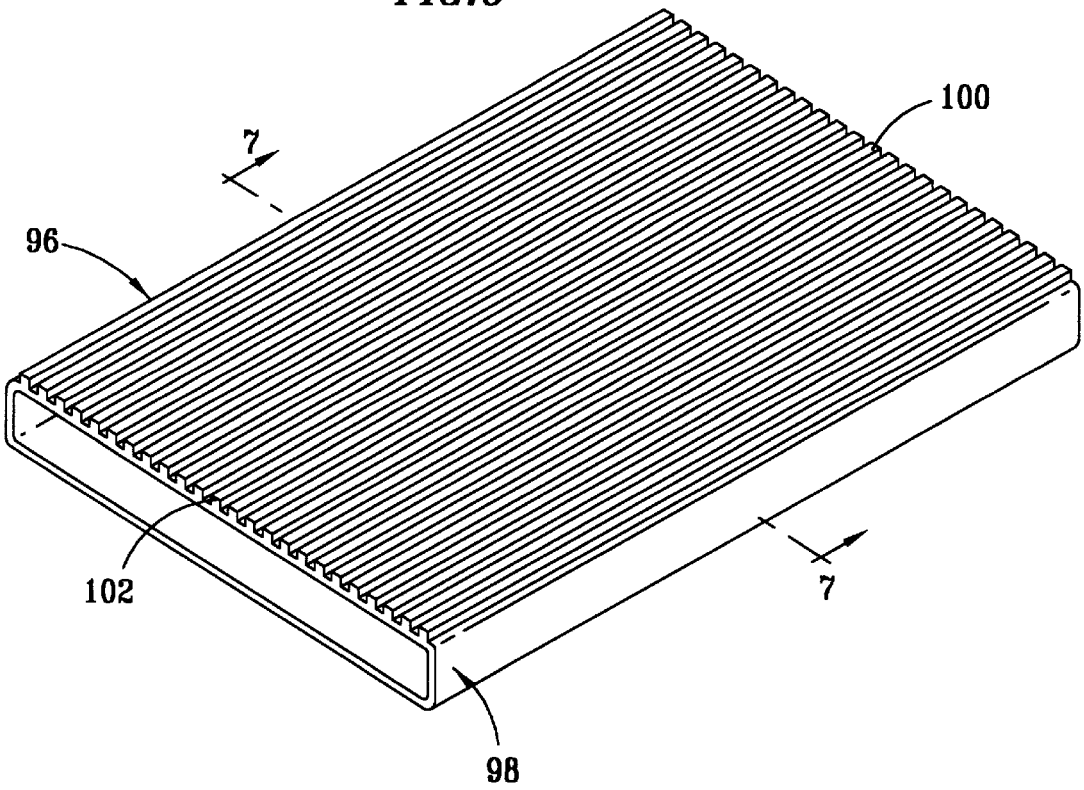
FIG. 6 illustrates a perspective view of a heating unit for a microwave grill of an alternative embodiment of the present invention.

Referring now to FIG. 6, there is illustrated a perspective view of a heating unit 96 for a microwave grill of an alternative embodiment of the present invention. The heating unit 96 includes a unitary structure of a glass enclosure 98. The glass enclosure 98 is preferably made of lead free glass. A heating surface 100 is defined by one side of the glass enclosure 98. The heating surface has longitudinally extending ribs 102. Preferably, the tips of the ribs 102 define the heating surface 100.

Figure 7:
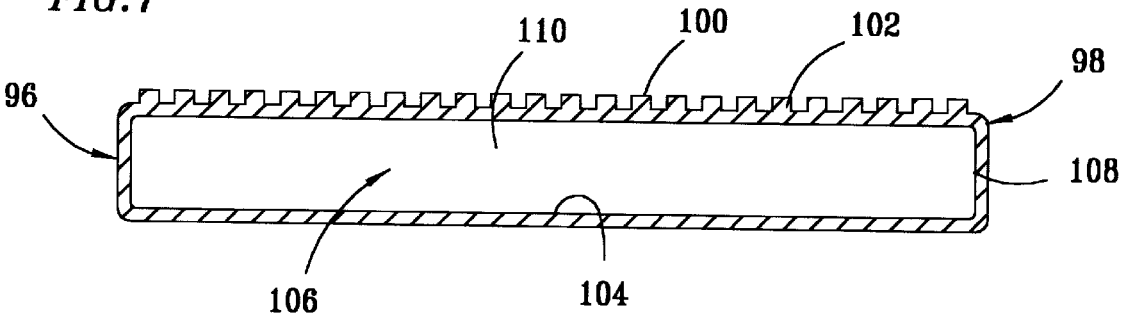
FIG. 7 illustrates a cross-sectional view of the heating unit of FIG. 6, taken along section line 7—7.

Referring now to FIG. 7, there is illustrated a sectional view of the heating unit 96, taken along section lines 7—7 of FIG. 6. The glass enclosure 98 of the heating unit 96 defines an interior cavity 104. An inert gas 106 is sealed within the cavity 104. Neon may be used as the inert gas 106. Six sidewalls 108 extend around all six sides of the glass enclosure 98 to define the sealed cavity 104. The walls 108 are preferably each at right angles to adjacent ones of the walls 108, and are parallel to oppositely facing ones of the walls 108. Two end plates 110 (one shown) define two spaced apart ones of the sidewalls 108 which are disposed on opposite sides of the enclosure 98. The thickness of the glass sidewalls 108 are selected such that the inert gas 106 will be contained within the interior cavity 104 of the enclosure 98 when the heating unit 96 is exposed to microwave energy. The walls 108 are one-sixteenth inches thick. When neon is used for the inert gas 106 and is exposed to the microwave energy of the oven 12, it will ionize emitting infrared radiation. Heat will then be transferred through the glass sidewalls 108 and to heating surface 100, and then to food placed on the heating surface 100.

In operation, the cover 16 will be removed from the drip pan 20. Then, the adjustment knobs 34 may be loosened and the upper heating unit 24 moved upwards, spaced apart from the lower heating unit 26 such that a food item may be placed upon the top of the lower heating unit 26. The food item is placed upon the lower heating unit 26 such that it is resting atop the lower heating surface 38. The upper heating unit 24 is then lowered downward, sliding the rods 32 downward within the slots 30 of the support members 28, until the upper heating surface 36 of the upper heating unit 24 is resting upon the top of the food item. The adjustment knobs 34 are then rotated to clamp respective ones of the support members 28 between the adjustment knobs 34 and the sides of the frame 48 of the upper heating unit 24. Then, the cover 16 is placed upon the drip pan 20, such that the downwardly extending lips 80 of the cover 16 engage within the inward facing sides of the sidewalls 44 of the drip pan 20. Then, the shudder members 86 may be rotated relative to the walls 74 of the cover 16 until the vent holes 90 are selectively aligned with the ports 82 to provide a selected cross-sectional area of alignment between the ports 82 and the vent holes 90. Then, the microwave grill 14 may be picked up and placed within the microwave oven 12 by gripping the handles 22. The microwave oven 12 is then operated to emit microwave energy into the microwave grill 14, exciting the inert gas 54 disposed within the interior cavity 56 of the tubular enclosures 50. When neon is used as the inert gas 54, it ionizes and emits infrared radiation.

Excitation of the inert gas 54 in response to the microwave energy causes radiant heat to transfer through the interior surface 60, the sidewalls 52 and the exterior surfaces 58 of the tubular enclosures 50, to the peripheral surface of a food item. The exterior surfaces 58 include the upper heating surface 36 and the lower heating surface 38, which are preferably in contact with the food items. Additionally, the upper and lower heating surfaces 36 and 38 are heated to elevated temperatures, and transfer heat directly to the periphery of the food item. Microwave energy will also simultaneously permeate the food item to cook the interior regions of the food item. According to the preferred embodiment of the present invention, the upper and lower heating surfaces 36 and 38 will be heated to temperatures such that moisture from the interior regions of the food item will be evaporated from the exterior regions of such food items as meat, poultry, fish and the like, to prevent moisture saturation of the exterior regions of the food items. Preferably, the heating surfaces will be heated to temperatures up to 275.0 degrees Fahrenheit, although higher temperatures may be attained in other embodiments. In some embodiments of the present invention, the peripheries of the food items in direct contact with the upper and lower heating surfaces 34 and 36 may become seared, drying out the exterior regions and sealing moisture within the interior regions.

The present invention provides several advantages over prior art microwave oven cooking devices. A microwave grill is provided for heating food to temperatures in response to microwave energy, such that the exterior surfaces of food items which are within the microwave grill will be heated to temperatures such that moisture is evaporated from the outer regions of the food items which are adjacent to the exterior peripheries. This allows the exterior surfaces of food items to become and then remain dry, without accumulating excessive moisture in these exterior surfaces as commonly occurs in conventional microwave ovens. An inert gas is used to provide a heating medium, minimizing the possibility of food contamination and allowing for repeated thermal cycling during repeated uses. The heating units of the microwave grill of the present invention are easily disassembled from the adjustable support members and the drip pan for ease of cleaning. The heating units, the drip pan and the adjustable support members, including the adjustment knob and the vent shudders, are made from dishwasher and microwave safe materials.

Although the preferred embodiment has been described in detail, it should be understood that various changes, substitutions and alterations can be made therein without departing from the spirit and scope of the invention as defined by the appended claims.

What is claimed is:

1. An apparatus for heating a material within a microwave oven, the apparatus comprising:

a plurality of tubular enclosures aligned in parallel, each of said tubular enclosures having a corresponding wall and a respective sealed interior cavity, said walls being permeable to microwave energy and at least in part defining respective ones of said sealed interior cavities of said enclosures;

an inert gas disposed within each of said sealed, interior cavities of said enclosures, said inert gas being energized in response to being exposed to the microwave energy;

a heating surface disposed on one side of said plurality of tubular enclosures, and between said inert gas and the material for heating in the microwave oven, such that said heating surface will transfer heat from said inert gas disposed within said plurality of tubular enclosures and to an exterior portion of the material being heated within the microwave oven; and wherein said inert gas is energized by the microwave energy which passes through said walls of said enclosures, and heat from said inert gas is transferred through the heating surface and to an exterior portion of the material being heated within the microwave oven.

2. The apparatus according to claim 1, wherein said heating surface is disposed adjacent to the exterior portion of the material being heated within the microwave oven such that said heating surface is in contact with the exterior portion of the material.

3. The apparatus according to claim 1, wherein said heating surface is defined by exterior peripheries of said walls of said enclosures.

4. The apparatus according to claim 1, wherein said enclosure walls are formed of glass and have peripheries which together define said heating surface.

5. The apparatus according to claim 1, wherein said inert gas comprises neon, and ionizes in response to being exposed to the microwave energy of the microwave oven.

6. The apparatus according to claim 1, wherein said enclosure walls are formed of glass and have peripheries which together define said heating surface, and said heating surface is disposed adjacent to the exterior portion of the material being heated within the microwave oven such that said heating surface contacts the exterior portion of the material.

7. The apparatus according to claim 1, wherein said tubular enclosures each comprise a tubular member which is sealed on two ends, such that said sealed cavities are disposed interiorly therein.

8. The apparatus according to claim 1, wherein said tubular enclosures each comprise a tubular member formed of glass, and said tubular members have exterior peripheries defined by said walls and which together define said heating surface.

9. The apparatus of claim 1, further comprising:

a cover having a top and a sidewall which are sized for enclosing said plurality of enclosures and the material being heated, said cover including at least one port extending through one of said top and said sidewall; and a shudder member moveably mounted to said cover and having at least one vent hole for selectively aligning with said at least one port in said cover to determine a selected cross-sectional area of alignment between said at least one vent hole with said at least one port for selecting positive cooking pressures within said cover.

10. An apparatus for heating a material within a microwave oven, the apparatus comprising:

an upper enclosure having a first wall and an upper, sealed, interior cavity, said first wall being permeable to microwave energy and at least in part defining said upper, sealed, interior cavity;

a lower enclosure having a second wall and a lower, sealed, interior cavity, said second wall being permeable to microwave energy and at least in part defining said lower, sealed, interior cavity;

an inert gas disposed within said upper and lower, sealed, interior cavities of said upper and lower enclosures, said inert gas being energized in response to being exposed to the microwave energy;

upper and lower heating surfaces disposed between said inert gas disposed within respective ones of said upper and lower, sealed interior cavities and two respective sides of the material for heating in the microwave oven, said upper and lower heating surfaces being disposed relative to the two respective sides of the material such that said upper and lower heating surfaces will transfer heat from said inert gas to the respective sides of the material being heated within the microwave oven;

at least one support member which extends upward from said lower enclosure and having a slot for slidably engaging said upper enclosure for positioning said upper enclosure relative to said lower enclosure, such that said upper and lower heating surfaces are selectively positionable at relative spacings from one another for selectively positioning relative to the respective sides of the material; and wherein said inert gas is heated to elevated temperatures by the microwave energy which passes through said first and second walls, and heat from the inert gas is transferred through said upper and lower heating surfaces and to the respective sides of the material being heated within the microwave oven.

11. The apparatus according to claim 10, wherein said upper and lower heating surfaces are disposed adjacent to the respective ones of the sides of the material being heated within the microwave oven such that said upper and lower heating surfaces are in contact with the respective ones of the sides of the material.

12. The apparatus according to claim 10, wherein said upper and lower heating surfaces are defined by outward peripheries of said upper and lower walls, respectively.

13. The apparatus according to claim 10, wherein said inert gas comprises neon, and ionizes in response to being exposed to the microwave energy of the microwave oven.

14. The apparatus according to claim 10, wherein said upper and lower enclosure walls are formed of glass and define said upper and lower heating surfaces, and said upper and lower heating surfaces are disposed adjacent to respective ones of the sides of the material being heated within the microwave oven such that said upper and lower heating surfaces contact the respective ones of the sides of the material.

15. The apparatus according to claim 10, wherein said upper and lower enclosures comprise tubular members which each comprise a plurality of tubular members which are each sealed on two ends, such that said upper and lower, sealed, interior cavities are disposed interiorly therein, respectively.

16. The apparatus according to claim 10, wherein said upper and lower enclosures each comprise a plurality of tubular members which are disposed in parallel and formed of glass, said pluralities of tubular members each having exterior peripheries which are defined by respective ones of said upper and lower walls and which together define respective ones of said upper and lower heating surfaces.

17. The apparatus of claim 10, further comprising:

a cover having a top and a sidewall which are sized for enclosing said upper and lower enclosures and the material being heated, said cover including at least one port extending through one of said top and said sidewall; and a shudder member moveably mounted to said cover and having at least one vent hole for selectively aligning with said at least one port in said cover to determine a selected cross-sectional area of alignment between said at least one vent hole with said at least one port for selecting positive cooking pressures within said cover.

18. A method for heating and grilling a material within a microwave oven, comprising the steps of:

providing upper and lower enclosures having heating surfaces for disposing on opposite sides of the material for heating in the microwave oven, each of the upper and lower enclosures having interior cavities with an inert gas disposed therein;

further providing a cover for enclosing the upper and lower enclosures and the material being heated, the cover having a vent which is selectively adjustable for selecting positive cooking pressures within said cover, placing the material above the lower enclosure, on top of one of the heating surfaces corresponding to the lower enclosure;

placing the upper enclosure above the material;

placing the cover over the upper and lower enclosures, with the material disposed therebetween;

adjusting the vent to select the positive cooking pressures within the cover;

applying microwave energy to the material and the upper and lower enclosures to directly heat the material and to excite the inert gas with the microwave energy; and transferring heat from the inert gas, through the respective heating surfaces of the upper and lower enclosures and to exterior portions of the material which are disposed adjacent to the respective heating surfaces of the upper and lower enclosures.

19. The method according to claim 18, wherein the step of applying the microwave energy to the inert gas ionizes the inert gas.

20. The method according to claim 19, further comprising the step of;

providing at least one support member to which the upper enclosure is slidably engaged for moving the upper enclosure relative to the lower enclosure, wherein the step of placing the lower enclosure on top of the material includes the step of slidably engaging the upper enclosure with the support member.

21. The method according to claim 20, wherein the method of placing the upper enclosure above the material comprises bringing the upper heating surface into contact with the material, directly pressing against the periphery of the exterior portion of the material.

22. An apparatus for heating a material within a microwave oven, the apparatus comprising:

an enclosure having a wall and a sealed interior cavity, said wall being permeable to microwave energy and at least in part defining said sealed interior cavity of said enclosure;

an inert gas disposed within said sealed, interior cavity of said enclosure, said inert gas being energized in response to being exposed to the microwave energy;

a heating surface disposed between said inert gas and the material for heating in the microwave oven, such that said heating surface will transfer heat from said inert gas to an exterior portion of the material being heated within the microwave oven;

wherein said inert gas is energized by the microwave energy which passes through said wall, and heat from the inert gas is transferred through the heating surface and to an exterior portion of the material being heated within the microwave oven;

a cover having a top and a sidewall which are sized for enclosing said enclosure and the material being heated, said cover including at least one port extending through one of said top and said sidewall; and a shudder member moveably mounted to said cover and having at least one vent hole for selectively aligning with said at least one port in said cover to determine a selected cross-sectional area of alignment between said at least one vent hole with said at least one port for selecting positive cooking pressures within said cover.

23. The apparatus according to claim 22, wherein said shudder member is rotatably mounted to said cover for selectively aligning said at least one vent hole in said shudder member with said at least one port in said cover.

24. The apparatus of claim 23, further comprising a drip pan having upwardly extending sidewalls for fitting against said cover to provide a seal for sealing positive pressure within an interior of said cover.

* * * * *